United States Patent [19]

Sellke et al.

[11] Patent Number: 4,909,296

[45] Date of Patent: Mar. 20, 1990

[54] WATER-TIGHT SEALING SYSTEM FOR ARTICULATED SLATS

[76] Inventors: Richard G. Sellke, 2220 S. Pinon Ct., Denver, Colo. 80210; Richard B. Rader, 3739 E. 113th Ave., Thornton, Colo. 80233

[21] Appl. No.: 162,565

[22] Filed: Mar. 1, 1988

[51] Int. Cl.[4] ..... E04F 10/06

[52] U.S. Cl. ..... 160/67; 160/235; 160/41

[58] Field of Search ..... 160/67, 41, 236, 235, 160/68, 69, 70, 61, 42, 40

[56] References Cited

U.S. PATENT DOCUMENTS 3,216,102 11/1965 Vecchiarelli ..... 160/235 X
4,331,169 5/1982 Bonser ..... 160/67 X
4,433,714 2/1984 Barber ..... 160/235
4,634,172 1/1987 Duda ..... 160/66 X

FOREIGN PATENT DOCUMENTS 236057 2/1964 Austria ..... 160/236
400526 4/1966 Switzerland ..... 160/235

*Primary Examiner*—Ramon S. Britts
*Assistant Examiner*—David M. Purol

[57] ABSTRACT

A system for establishing a water-tight seal along a joint between articulated slats of the type which might be used along the inner edge of a retractable awning includes the use of male and female connection elements along opposite edges of the slats and a resilient strip of material bridging the space between connected male and female elements to prevent the passage of water through the joint.

2 Claims, 1 Drawing Sheet

WATER-TIGHT SEALING SYSTEM FOR ARTICULATED SLATS

BACKGROUND OF THE INVENTION

1. Field Of The Invention

The present invention relates generally to the joint between articulated slats of the type which might be used in a retractable awning to conceal the awning and protect the same from environmental elements and more particularly to a system for sealing the joints between adjacent slats to prevent the leakage of water therethrough.

2. Description of the Prior Art

Retractable awnings have been utilized for many years, particularly as awnings for windows or entry doors of building structures. The awnings are typically rolled out during daylight hours to block undesired sun rays and rolled in at night when the sun has gone down. Such awnings normally include a roll bar which is mounted in a movable manner along an outer edge of the awning sheet so as to roll away from and back to the building as the awning is extended and retracted respectively.

More recently, retractable awning have also been mounted on the sides of mobile homes, recreational vehicles, travel trailers or the like. These newer versions of the retractable awning normally include support posts for supporting the outer edge of the awning sheet either by forming a brace from a side wall of the vehicle or by forming a ground support.

A concern with all retractable awnings relates to deterioration of the awnings such as is caused by adverse weather elements or prolonged exposure to the sun. Accordingly, when the awnings are retracted into a nonuse position, it is not uncommon to provide a strip of weather retardant fabric or rubberized material adjacent the inner edge of the awning sheet so that when the awning sheet is completely rolled into its retracted position, the weather retardant material will surround the remaining portion of the awning sheet thereby protecting the awning sheet from adverse environmental elements and ultraviolet radiation from the sun. Some retractable awnings of the type mounted on recreational vehicles and the like have even been mounted in metallic boxes so that the box can be closed to seal the awning therein when not in use.

A more recent development adapted to protect an awning from environmental elements when the awning is not in use utilizes a plurality of elongated slats, usually of aluminum, which are pivotally connected together along their length in an articulated manner so as to envelope or encapsulate the awning when it is rolled into its retracted position. The articulated slats take the place of the weather-retardant fabric materials which have been used previously, but one problem with the articulated slats is that the joints between adjacent slats are not water tight. Accordingly, rain water and the like will typically seep between adjacent slats and leak underneath the awning in an undesired manner.

One system which addresses the problem of seepage is disclosed in U.S. Pat. No. 4,634,172 issued to Henry J. Duda on Jan. 6, 1987, and entitled FLEXIBLE HINGE RAIN SEALING MECHANISM. This mechanism is only useful in connecting the innermost slat to the side of the vehicle and does so by utilizing a connection strap made of a flexible material which is seated in opposing C-shaped grooves provided in a mounting rail on the vehicle wall and the innermost slat. The flexible strap cooperates with the metal material on the mounting rail and the slat to effect a water-tight seal when a stress is placed on the joint. Such a system for making a joint water tight is not useful between adjacent articulated slats but is only useful at the juncture of one of those slats with the mounting rail on the vehicle wall.

Accordingly, it is a primary object of the present invention to provide a system for establishing a water-tight seal between adjacent articulated members.

It is another object of the present invention to provide a water-tight seal between elongated metallic slats which are pivotally innerconnected by a tongue-in-groove type connection.

It is a further object of the present invention to provide a system for establishing a water-tight seal between articulated slats that are utilized along one edge of a retractable awning to conceal the awning by encapsulating such when it is moved into its retracted position.

SUMMARY OF THE INVENTION

The present invention in general concerns a water-tight sealing system for use with pivotally connected or articulated members and more particularly to the use of such a sealing system with the articulated slats which are used to encase a retractable awning when the awning is in its retracted or nonuse position.

When retractable awnings are not in use, they are usually rolled up adjacent a surface upon which they are supported. To prevent the awning fabric from deteriorating as a result of exposure to adverse environmental conditions or the sun, some such awnings are encapsulated in their retracted position in a metal sleeve composed of a plurality of pivotally interconnected slats. Such slats form a generally cylindrical body in which the awning canopy can be retained and protected in a rolled up condition. The slats are typically made of a rigid material, such as aluminum, with each slat having a male connection element on one longitudinal edge and a mating female connection element along the opposite longitudinal edge so that the male element of one slat can be pivotally received in the female element of an adjacent slat. With the slats so interconnected, they can be wrapped around the roll bar and canopy of the retractable awning. Normally the pivotally connected or articulated slats form an extension or connector between the supporting surface for the retractable awning and the canopy or awning sheet itself. In other words, one of the articulated slats is operably connected to the supporting surface while the most distant articulated slat is connected to the awning sheet whereby subsequent to the awning sheet being wrapped around the roll bar, the articulated slats will wrap around the roll bar and awning sheet as the roll bar and sheet approach the supporting surface.

The present invention for establishing a water-tight seal along the joint between adjacent slats utilizes a resilient sealing strip to bridge the space existing between the male and female elements of joined articulated slats. The sealing system establishes a water-tight barrier along the joint to prevent water from seeping through the joint in an undesired manner. In the preferred embodiment described hereinafter, the male and female elements define channels of generally C-shaped transverse cross-section whereby the male element can receive and retain the resilient strip in a manner such that it protrudes away therefrom into compressive, sliding engagement with the female element to establish the desired water-tight seal.

Other aspects, features and details of the present invention can be more completely understood by reference to the following detailed description of a preferred embodiment, taken in conjunction with the drawings, and from the appended claims.

DESCRIPTION OF THE PREFERRED EMBODIMENT

Figure 1:
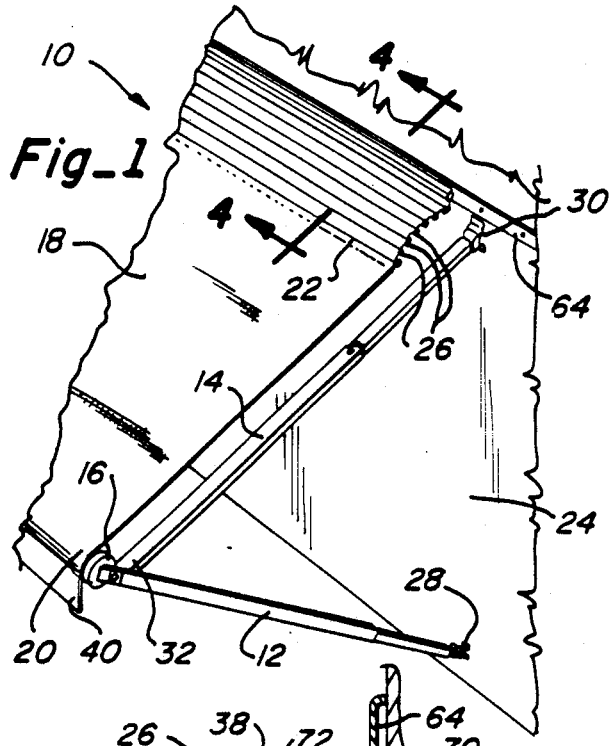
FIG. 1 is a fragmentary perspective view of a retractable awning in its extended position utilizing the sealing system of the present invention.
Figure 2:
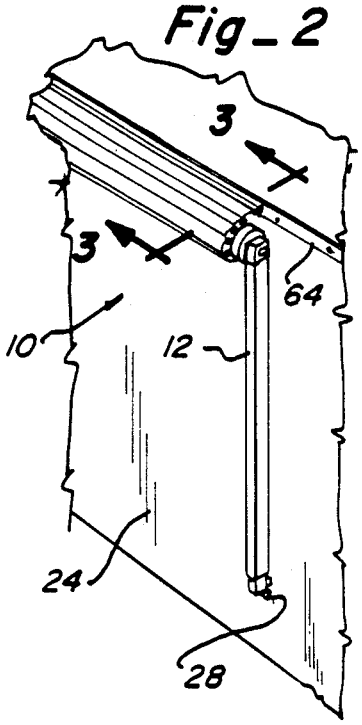
FIG. 2 is a fragmentary perspective view similar to FIG. 1 with the awning shown in a retracted position.

Referring first to FIGS. 1 and 2, a retractable awning 10 incorporating the sealing system of the present invention is illustrated and includes a pair of support arms 12 (only one being seen), a pair of brace members 14 (only one being seen), a roll bar 16 rotatably mounted on the distal ends of the support arms 12, an awning sheet or canopy 18 connected along an outer edge 20 to the roll bar 16 and having its inner edge 22 operably connected to the side of a support surface 24 through a plurality of articulated slats 26.

The support arms 12 have a lower end pivotally connected to lower support brackets 28 mounted on the support surface 24, while the brace members 14 have upper ends pivotally connected to upper brackets 30 on the support surface. The opposite or lower end 32 of each brace member is slidably received in an associated support arm for movement along the length thereof. With this arrangement, the awning can be moved between the extended position of FIG. 1 and the retracted position of FIG. 2.

The awning sheet 18 is attached to the roll bar 16 in any conventional manner but in the disclosed embodiment of the awning, the roll bar is of elongated cylindrical configuration having a plurality of grooves 34 of C-shaped cross-section formed in the surface thereof. The outer edge 20 of the awning sheet is hemmed to define a sleeve 36 which is inserted into one of the C-shaped grooves 34 in the roll bar and it is retained therein by inserting a rod or other tubular member 38 through the sleeve. The rod 38 has a diameter of sufficient size to be retained in the C-shaped groove. Similarly, a valence 40 might be attached to the roll bar in an identical manner as is illustrated in FIGS. 1 and 3.

Figure 3:
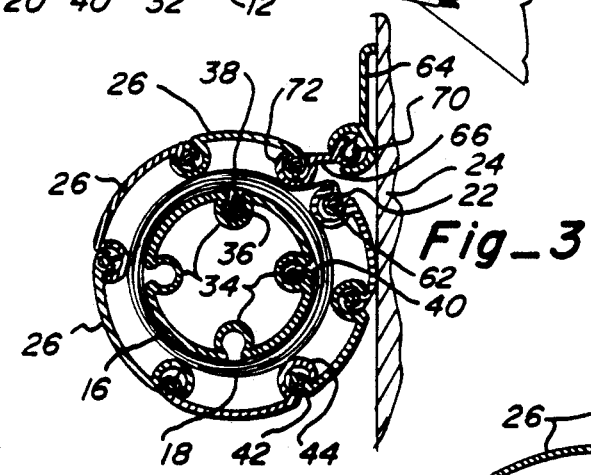
FIG. 3 is an enlarged section taken along line 3—3 of FIG. 2.
Figure 4:
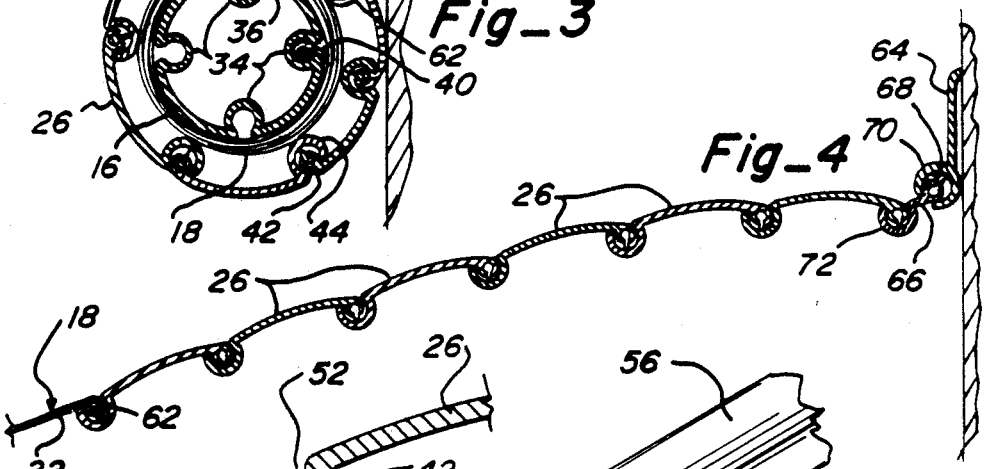
FIG. 4 is an enlarged fragmentary section taken along line 4—4 of FIG. 1.

The articulated slats 26 which form an extension from the support surface 24 and a means for connecting the awning sheet to the support surface are best illustrated in FIGS. 3 and 4. Each slat is identical and may be made of a fairly rigid material such as aluminum. The slats are elongated and of a length equal to the width of the awning sheet 18 and are slightly arcuate in transverse cross-section. Each slat has a bead or male connection element 42 along one edge and a mating female connection element 44 along the opposite edge so that the male connection element of one slat can be inserted into the female connection element of an adjacent slat to form an articulated tongue-in-groove type joint between the slats.

Figure 5:
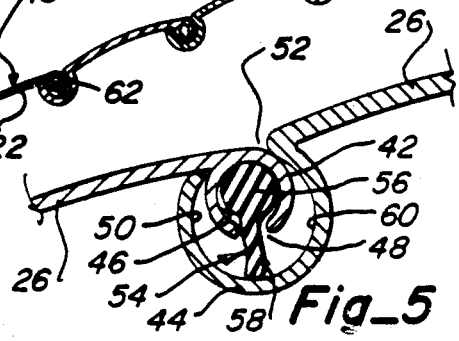
FIG. 5 is a further enlarged transverse section taken through a joint between adjacent articulated slats forming a part of the retractable awning of FIG. 1.

As best illustrated in FIG. 5, the male connection element 42 projects substantially perpendicularly away from the concave side of the slat and has a groove 46 of generally C-shaped cross-section extending along its length. The groove 46 defines a relatively narrow slot 48 along the length of the male element with the slot 48 opening away from the concave side of the slat. The female element 44 which extends along the opposite edge of the slat also extends away from the concave side of the slat and has a groove 50 of C-shaped cross-section formed therein. The C-shaped groove 50, however, opens through a slot 52 that faces the opposite direction from the slot 48 in the male element.

The male element 42 has a larger diameter than the width of the slot 52 in the female element 44 so that the male element can be pivotally received and retained in the groove 50 of the female element of an adjacent slat. Of course, the male element is inserted into the female element longitudinally for purposes of connecting adjacent slats.

Figure 6:
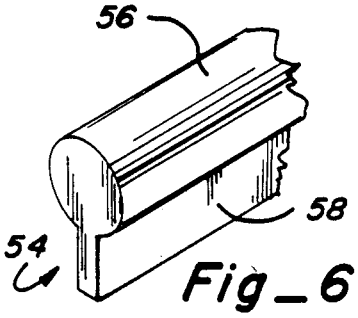
FIG. 6 is an enlarged fragmentary perspective view of the resilient sealing strip utilized in the sealing system of the present invention.

A sealing strip 54, which is best illustrated in FIGS. 5 and 6, is fabricated from a resilient material such as rubber and includes a cylindrical main body portion 56 having a leg 58 of generally rectangular transverse cross-section forming a radial projection from the main body. The diameter of the main body 56 is slightly smaller than the diameter of the C-shaped groove 46 in the male element 42 but is larger than the slotted opening 48 in the male element so that the resilient strip can be retained in the male element with the rectangular leg 58 projecting away therefrom toward the confronting inner surface 60 of the C-shaped groove 50 in the female element. The length of the leg 58 is such that it will engage the inner surface 60 of the female element and form a water-tight seal therewith when adjacent interconnected slats are fully articulated in one direction or another but will not engage the surfaced 60 at an intermediate position of the two slats. In other words, when adjacent slats are fully articulated in one direction as when the awning is fully extended, the leg 58 engages the surface 60 and when adjacent slats are fully articulated in the opposite direction as when the awning is fully retracted, the leg 58 engages the surface 60. However, at an intermediate position between the extended and retracted positions of the awning, the leg 58 does not engage the surface 60 to facilitate assembly of a joint between articulated slats. At the intermediate position, since there is no engagement between the sealing strip and the female element, the strip can be easily inserted longitudinally into a male element, or if previously inserted into the male element, the male element will easily slide into the female element so that assemblage of adjacent slats is accomplished in a simple and efficient manner.

As will be appreciated and as illustrated in FIG. 4, the outermost edge of the outermost slat 26 utilized in the awning has a female element 44 therealong and the inner edge 22 of the awing sheet is connected thereto. The connection of the awning sheet to the outermost slat 26 is made by inserting a hem along the inner edge of the awning sheet into the C-shaped groove 50 of the female element and thereafter inserting a rod or other tubular member 62 through the hem to retain the inner edge of the awning sheet in the female element of the outermost slat.

Similarly, the innermost edge of the innermost slat 26 utilized in the awning has a male element 42 extending therealong which is connected to a mounting rail 64 affixed to the supporting surface 24 by a joinder member 66. The mounting rail is an elongated rigid element that is affixed to the supporting surface in any suitable manner and has a downwardly and outwardly opening groove 68 of generally C-shaped cross-section. The joinder member 66 is an elongated bar of either rigid or flexible material that has a channel-shaped male member 70 along one edge and a channel-shaped female member 72 along the opposite edge. The channels 70 and 72 are of generally C-shaped cross-section with the male member 70 being adapted to fit within and be retained in the groove 68 provided on the mounting rail and the female member 72 adapted to receive and retain the male element 42 of the innermost slat 26. In order to establish a water-tight seal at this juncture, a resilient strip of the type disclosed in FIG. 6 can be inserted into the male element 42 of the innermost slat 26 and into the male member 70 of the joinder member 66.

In operating the awning, it will be appreciated in the extended position illustrated in FIG. 1 that the articulated slats 26 form an extension from the support surface 24 which is substantially coplanar with the awning sheet 18 itself. Each joint between articulated slats, of course, is sealed by the system disclosed herein so that water will not leak through the joints between adjacent articulated slats. The awning is moved to its retracted position of FIG. 2 by allowing the outermost end of the brace members 14 to slide inwardly along the length of the associated support arm 12 until the support arm is moved into a vertical orientation. As this occurs, the awning sheet 18 is wrapped around the roll bar 16 until the roll bar reaches the inner edge 22 of the awning sheet and thereafter, the roll bar along with the wrapped awning sheet are incapsulated by the articulated slats 26 which collapse and form a cylindrical protective case therearound. Of course, when the awning is again extended, the cylindrical case formed by the articulated slats opens up and extends away from the support surface. It should also be appreciated, however, that even when the awning is retracted, the sealing system of the present invention prevents water from passing through the joints between the articulated slats thereby avoiding possible water damage to the awning sheet which is encased therein.

Although the present invention has been described with a certain degree of particularity, it is understood that the present disclosure has been made by way of example, and changes in detail or structure may be made without departing from the spirit of the invention, as defined in the appended claims.

We claim:

1. In a system establishing a water-tight connection between adjacent articulated slats wherein one slat has a male member having an elongated groove of generally C-shaped cross-section along an edge thereof defining an inner generally cylindrical surface of the male member and a slot of narrower width than the cylindrical surface, and an adjacent slat has a female member having an elongated groove of generally C-shaped cross-section along an edge thereof defining an inner generally cylindrical surface of the female member and a slot of narrower width than the cylindrical surface of the female member, wherein the male member is pivotally received in the groove of the female member with a space existing between the male member and the cylindrical surface of the female member and wherein the slot in the male member is in a confronting relationship with the cylindrical surface of the female member, wherein the improvement comprises: a resilient elongated strip having a generally cylindrical body portion and a leg disposed thereon and projecting away from the body portion and wherein the body portion is retained in the elongated groove of the male member, and wherein the leg projects out of the slot in the male member and sealingly engages the cylindrical surface of the female member.

2. In the system of claim 1 wherein said leg forms a radial extension from the body portion of the resilient elongated strip.

* * * * *